US012687338B2

(12) United States Patent
Bhavsar et al.

(10) Patent No.: US 12,687,338 B2
(45) Date of Patent: Jul. 21, 2026

(54) REFRIGERATOR AND STORAGE SYSTEM FOR A REFRIGERATOR

(71) Applicant: WHIRLPOOL CORPORATION, Benton Harbor, MI (US)

(72) Inventors: Yogeshkumar G. Bhavsar, Pune (IN); Anup R. Khandekar, Pune (IN); Mrunal S Shaldar, Pune (IN); Lalit Madhukar Suryawanshi, Pune (IN); Nilesh S. Zanwar, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 100 days.

(21) Appl. No.: 18/798,281

(22) Filed: Aug. 8, 2024

(65) Prior Publication Data

US 2026/0043604 A1 Feb. 12, 2026

(51) Int. Cl.
*F25D 25/02* (2006.01)

(52) U.S. Cl.
CPC ..... *F25D 25/025* (2013.01); *F25D 25/022* (2013.01); *A47B 2210/175* (2013.01); *F25D 2400/18* (2013.01)

(58) Field of Classification Search
CPC .... F25D 25/025; F25D 2400/18; F25D 23/04; F25D 25/005; F25D 25/022; F25D 23/062; F16B 5/0004; F16B 2/22; F16B 5/0607; F16B 5/128; F16B 5/121;
(Continued)

(56) References Cited

U.S. PATENT DOCUMENTS 2,567,554 A * 9/1951 Davey ..... F16B 5/0028 33/492
3,197,935 A * 8/1965 Clancy ..... F16B 5/121 24/297

(Continued)

FOREIGN PATENT DOCUMENTS

CN 108826812 A * 11/2018 ..... F25D 25/025
CN 111189288 A * 5/2020 ..... F25D 25/025

(Continued)

OTHER PUBLICATIONS

DE4304484 translation (Year: 1994).*

(Continued)

*Primary Examiner* — Hiwot E Tefera
(74) *Attorney, Agent, or Firm* — Brooks Kushman P.C.

(57) ABSTRACT

A refrigerator appliance includes a cabinet and a storage bin. The cabinet defines and internal refrigerated cavity. The storage bin is slidably secured to the cabinet within the internal cavity. The storage bin includes a plurality of walls, a protrusion, and trim. The plurality of walls defines a storage space. The protrusion extends upward from an upper edge of a front wall of the plurality of walls. The protrusion has at least one ramped surface and tapers along the at least one ramped surface in a direction extending upward and away from the upper edge of the front wall. The trim has a top panel and opposing snaps extending downward from the top panel. The snaps are operable for lateral displacement upon engagement with the at least one ramped surface. The snaps engage a lower region of the protrusion to secure the trim to the protrusion.

20 Claims, 5 Drawing Sheets

(58) Field of Classification Search
CPC ..... A47B 2095/024; A47B 2210/17; A47B 95/043; A47B 95/046; A47B 2210/175
See application file for complete search history.

(56) References Cited

U.S. PATENT DOCUMENTS

| | | | | | |
|---|---|---|---|---|---|
| 3,233,644 | A * | 2/1966 | Bono | B62B 5/0006 | 220/655 |
| 3,854,269 | A * | 12/1974 | Hancock | F16B 5/0607 | 52/282.1 |
| 4,087,141 | A * | 5/1978 | Roberts | A47B 95/02 | 16/412 |
| 4,858,413 | A * | 8/1989 | Grushka | A47B 95/043 | 312/352 |
| 5,013,596 | A * | 5/1991 | Kessler | E04F 19/028 | 24/297 |
| 5,096,753 | A * | 3/1992 | McCue | E04F 19/026 | 24/297 |
| 9,241,568 | B2 | 1/2016 | Crookshanks et al. | | |
| 10,480,847 | B2 * | 11/2019 | Heisswolf | F25D 23/02 | |
| 2009/0039749 | A1 * | 2/2009 | Gerstner | F25D 23/04 | 312/404 |
| 2018/0180351 | A1 * | 6/2018 | Ertik | F25D 25/025 | |
| 2020/0408462 | A1 * | 12/2020 | Feldmeyer | F25D 25/025 | |
| 2021/0245687 | A1 * | 8/2021 | DiAntonio | B60R 19/24 | |
| 2023/0258389 | A1 | 8/2023 | Choy et al. | | |

FOREIGN PATENT DOCUMENTS

| | | | | |
|---|---|---|---|---|
| DE | 4304484 | A1 * | 8/1994 | F25D 25/025 |
| DE | 202005008286 | U1 * | 10/2006 | A47B 88/90 |
| DE | 102016002296 | A1 * | 7/2017 | F25D 25/025 |
| DE | 102021104066 | A1 * | 8/2022 | F25D 25/025 |
| EP | 1985204 | B1 | 4/2015 | |
| EP | 3191779 | B1 | 7/2017 | |
| KR | 20060129752 | A * | 12/2006 | F25D 23/028 |
| KR | 20070062212 | A * | 6/2007 | F25D 25/022 |
| WO | 2016107738 | A1 | 7/2016 | |

OTHER PUBLICATIONS

DE-202005008286 translation (Year: 2006).*
CN111189288 translation (Year: 2020).*
DE 102021104066 translation (Year: 2022).*
CN 108826812 translation (Year: 2018).*

* cited by examiner

REFRIGERATOR AND STORAGE SYSTEM FOR A REFRIGERATOR

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator appliance includes a cabinet and a storage bin. The cabinet defines and internal refrigerated cavity. The storage bin is slidably secured to the cabinet within the internal cavity. The storage bin includes a plurality of walls, a protrusion, and trim. The plurality of walls defines a storage space. The protrusion extends upward from an upper edge of a front wall of the plurality of walls. The protrusion has at least one ramped surface and tapers along the at least one ramped surface in a direction extending upward and away from the upper edge of the front wall. The trim has a top panel and opposing snaps extending downward from the top panel. The snaps are operable for lateral displacement upon engagement with the at least one ramped surface. The snaps engage a lower region of the protrusion to secure the trim to the protrusion.

A storage bin for a refrigerator appliance includes a basket, an overhanging region, a protrusion, and trim. The basket defines a storage space. The overhanging region extends laterally outward from the basket along an upper edge of the basket and along a first side of the basket. The overhanging region forms a handle for engaging the basket. The protrusion extends upward from the overhanging region. The protrusion has at least one ramped surface and tapers along the at least one ramped surface in a direction extending upward and away from the overhanging region. The trim has an upper wall, opposing side walls extending downward from the upper wall, and barbs disposed along opposed ends of the side walls relative to the upper wall. The barbs are operable for lateral displacement upon engagement with the at least one ramped surface. The barbs engage a lower region of the protrusion to secure the trim to the protrusion.

A storage basket for a refrigerator appliance includes a plurality of walls, an elongated protrusion, and an elongated trim. The plurality of walls defines a storage space. The elongated protrusion extends outward from an edge of a first wall of the plurality of walls and between opposing lateral ends of the first wall. The elongated protrusion has ramped surfaces and tapers along the ramped surfaces in a direction extending away from the edge of the first wall. The elongated trim has a base and opposing snaps extending downward from the base. The snaps are operable for lateral displacement upon engagement with the ramped surfaces. The snaps engage a lower region of the protrusion to secure the trim to the protrusion. The elongated trim extends between the opposing lateral ends of the first wall.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
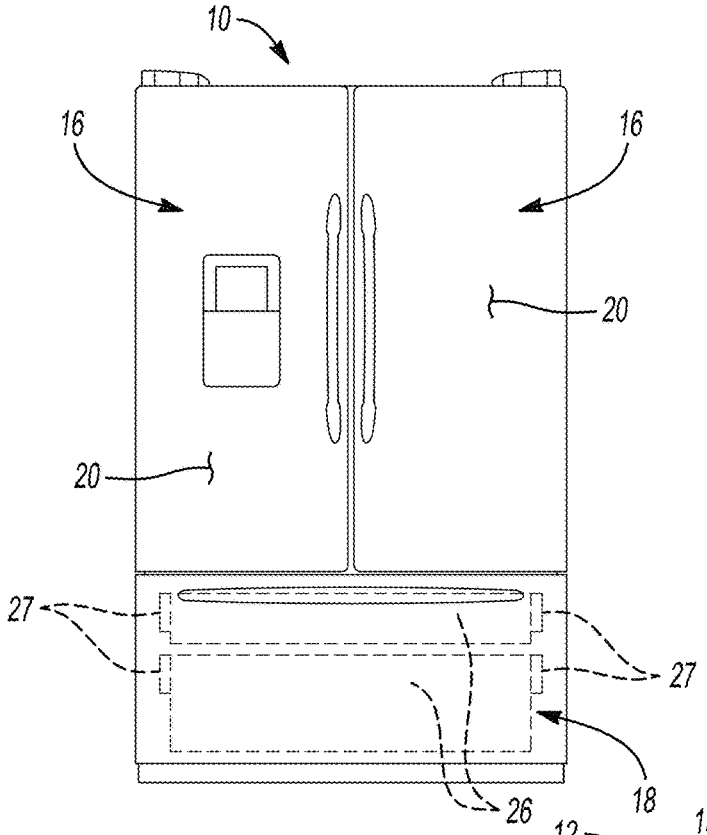
FIG. 1 is an elevated front view of a French-Door Bottom Mount type refrigerator appliance.
Figure 2:
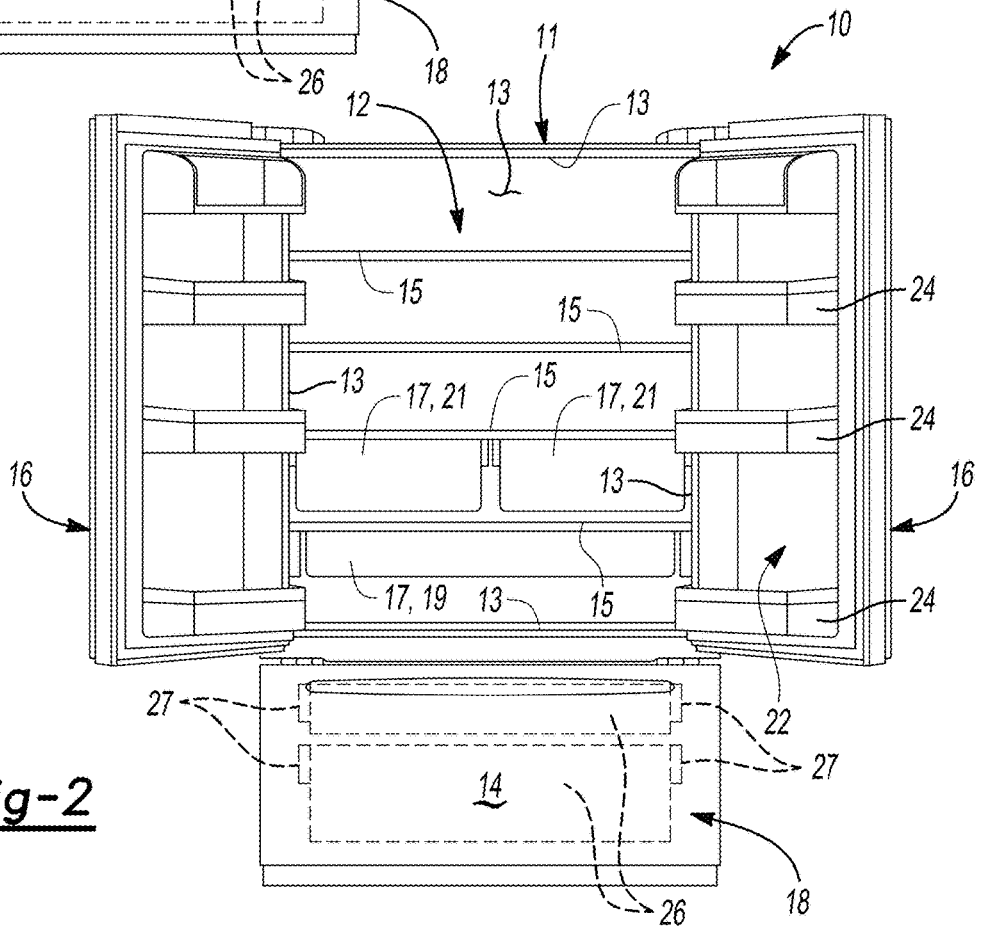
FIG. 2 is an elevated front view of a French-Door Bottom Mount type refrigerator with the refrigerator compartment doors open.

Referring to FIGS. 1 and 2, generally a refrigerator 10 of the French-Door Bottom Mount type is illustrated. However, it should be understood that this disclosure could apply to any type of refrigerator, such as a side-by-side, two-door bottom mount, or a top-mount type. As shown in FIGS. 1 and 2, the refrigerator 10 may have a first internal refrigerated storage chamber, first internal refrigerated cavity, or fresh food compartment 12 configured to refrigerate and not freeze consumables within the fresh food compartment 12, and a second internal refrigerated storage chamber, second internal refrigerated cavity, or a freezer compartment 14 configured to freeze consumables within the freezer compartment 14 during normal use. The refrigerator 10 includes panels or walls 13 that form a cabinet 11 or housing. The cabinet 11, or more specifically the walls 13, may define the fresh food compartment 12 and the freezer compartment 14. The walls 13 may form an internal liner of the refrigerator 10, or more specifically an internal liner of the cabinet 11. The walls 13 may include a rear or back wall, a top wall, a bottom wall, and two side walls.

One or more shelves 15 may be secured to the walls 13 within the fresh food compartment 12. One or more storage bins, storage baskets, storage receptacles, or drawers 17 may be slidably secured to the shelves 15, the walls 13, or the cabinet 11 within the fresh food compartment 12. More specifically, the drawers 17 may be slidably secured to the shelves 15 or the walls 13 within the fresh food compartment 12 via tracks or rails. One or more of the drawers 17 may be either a pantry drawer 19 or a crisper drawer 21. Crisper drawer 21 may more specifically be drawers defining a storage space that is kept at a desired humidity that may be different from the remainder of the fresh food compartment 12, but that is optimal for maintaining freshness of fruits and vegetables.

The refrigerator 10 may have one or more doors 16, 18 that provide selective access to the interior volume of the refrigerator 10 where consumables may be stored. As shown, the fresh food compartment doors are designated 16, and the freezer door is designated 18. It may also be shown that the fresh food compartment 12 may only have one door 16. The doors 16 may be rotatably secured to the walls 13 by one or more hinges.

It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F.

The doors 16 may each include an exterior panel 20 and an interior panel 22 that is disposed on an internal side of the respective exterior panel 20 of each door 16. The interior panels 22 may be configured to face the fresh food compartment 12 when the doors 16 are in closed positions (See FIG. 1). The interior panel 22 may more specifically be a door liner. An insulating material, such as an insulating foam, may be disposed between the exterior panel 20 and interior panel 22 of each door 16 in order reduce the heat transfer from the ambient surroundings and increase the efficiency of the refrigerator.

The refrigerator 10 may also have a water inlet that is fastened to and in fluid communication with a household water supply of potable water. Typically, the household water supply connects to a municipal water source or a well. The water inlet may be fluidly engaged with one or more of a water filter, a water reservoir, and a refrigerator water supply line. The refrigerator water supply line may include one or more nozzles and one or more valves. The refrigerator water supply line may supply water to one or more water outlets; typically one outlet for water is in the dispensing area and another to an ice tray. The refrigerator 10 may also have a control board or controller that sends electrical signals to the one or more valves when prompted by a user that water is desired or if an ice making cycle is required.

Such a controller may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the refrigerator 10.

The doors 16 may also include storage bins 24 that are able to hold food items or containers. The storage bins 24 may be secured to the interior panels 22 of each door 16. Alternatively, the storage bins 24 may integrally formed within or defined by the interior panels 22 of each door 16. In yet another alternative, a portion of the storage bins 24 may be secured to the interior panels 22 of each door 16, while another portion of the storage bins 24 may be integrally formed within or defined by the interior panels 22 of each door 16. The storage bins 24 may include shelves (e.g., a lower surface upon, which a food item or container may rest upon) that extend from back and/or side surfaces of the interior panels 22 of each door 16.

One or more storage bins, storage baskets, drawers, or storage receptacles 26 may be disposed within the freezer compartment 14. Alternatively, the one or more storage receptacles 26 may be disposed within the fresh food compartment 12. The one or more storage receptacles 26 may have an open top. The one or more storage receptacles 26 may be slidably secured to the cabinet 11 or the internal walls (e.g., walls 13) within the freezer compartment 14 or alternatively within the fresh food compartment 12. More specifically, the one or more storage receptacles 26 may be secured to the internal walls via linear guides or rails 27 such that the one or more storage receptacles 26 may slide forward and rearward relative to the refrigerator 10. The one or more storage receptacles 26 may slide forward and rearward relative to the refrigerator 10 independent from or in conjunction with the door 18.

Figure 3:
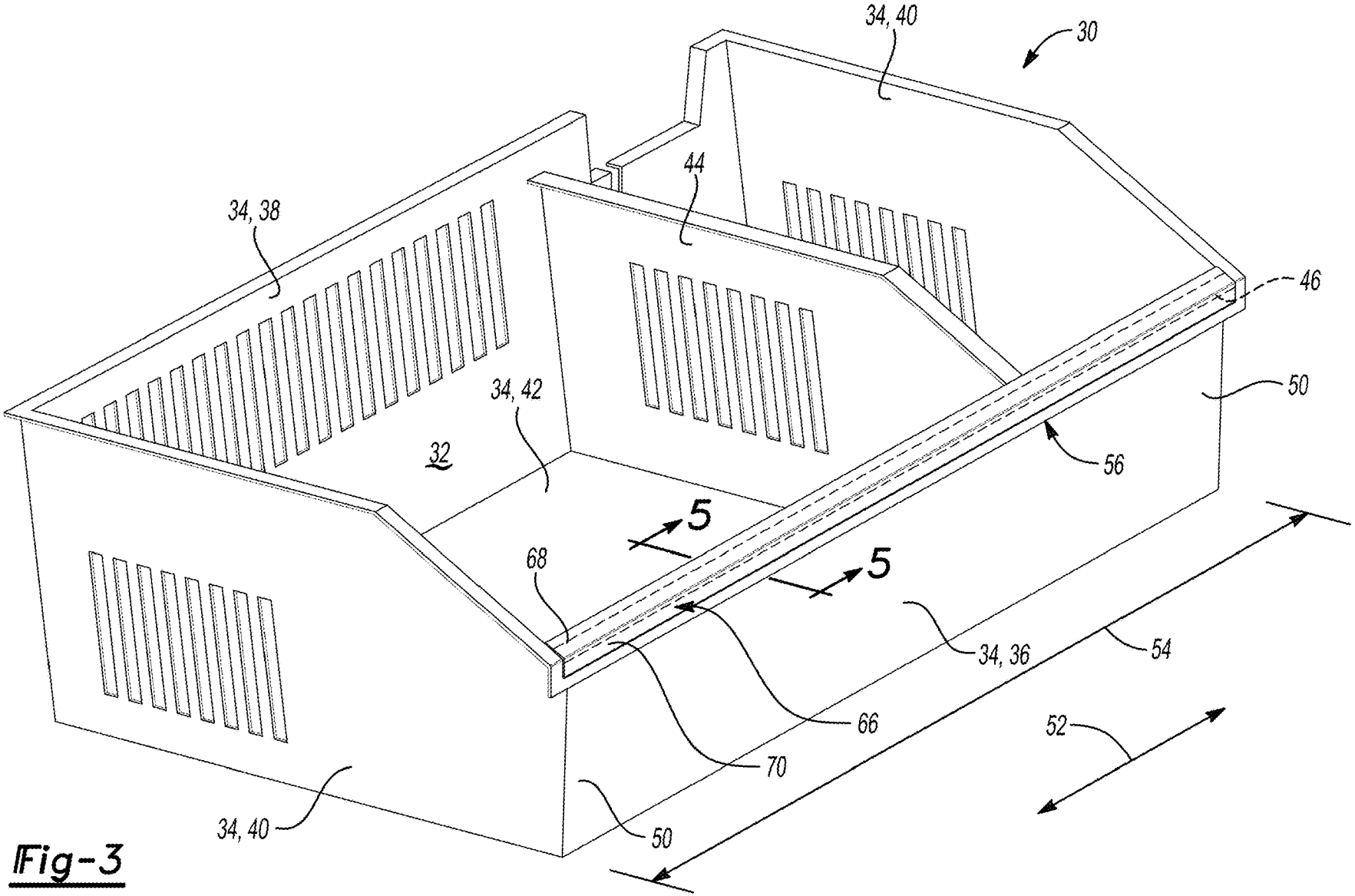
FIG. 3 is a perspective upper view of a first type of storage bin that is disposed within one of the compartments of the refrigerator.
Figures 4A, 4B:
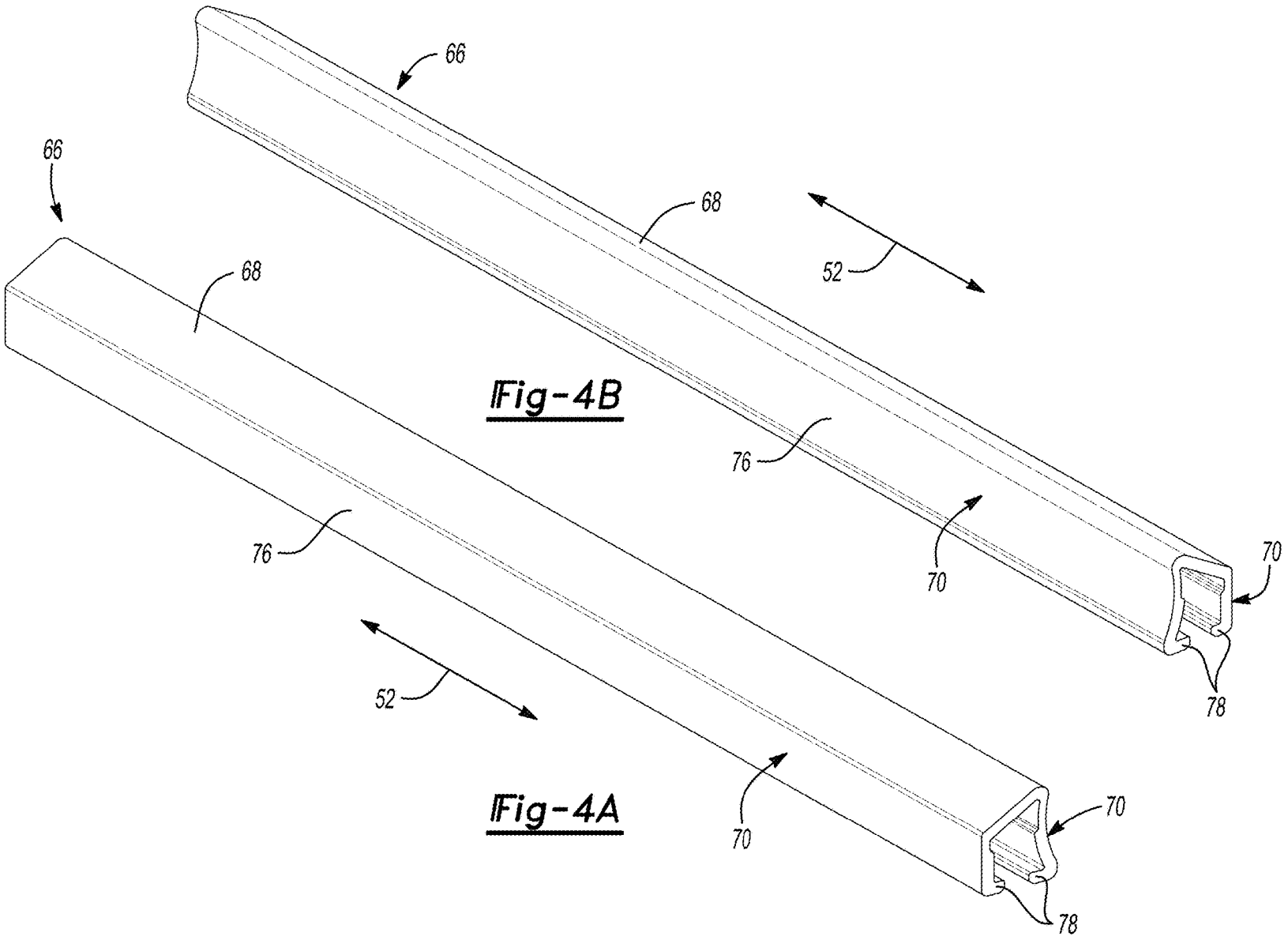
FIGS. 4A and 4B are perspective views of an elongated trim that is secured to the storage bin.
Figure 5:
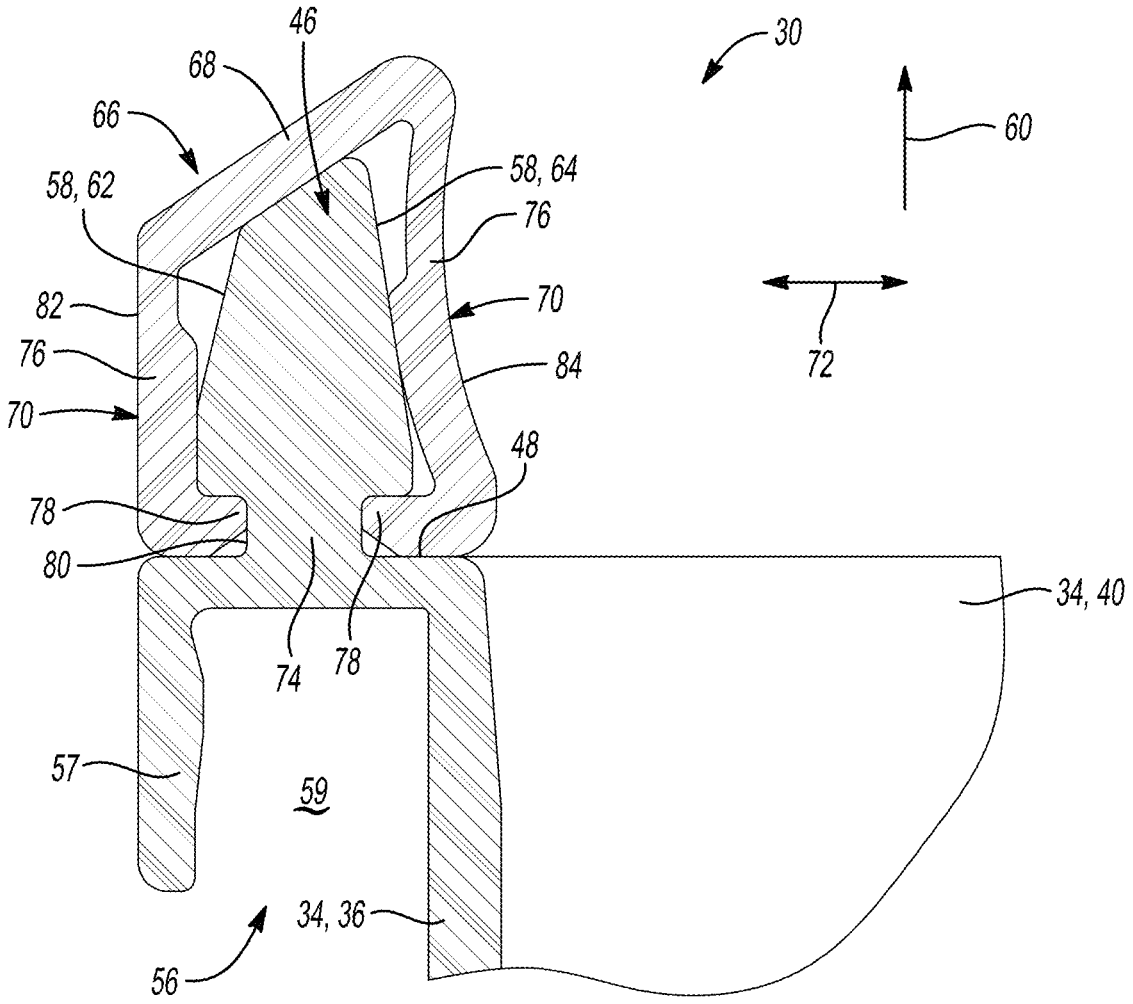
FIG. 5 is a cross-sectional view taken along line 5-5 in FIG. 3.

Referring to FIGS. 3-5, a first type of storage bin 30 that is disposed within one of the compartments of the refrigerator (e.g., the fresh food compartment 12 or the freezer compartment 14) is illustrated. The first type of storage bin 30 may correspond to one of the storage bins, storage baskets, storage receptacles, or drawers 17 depicted in FIG. 1 or to one of the storage bins, storage baskets, drawers, or storage receptacles 26 depicted in FIGS. 1 and 2.

The storage bin 30 defines a storage space 32. More specifically, the storage bin 30 includes a plurality of walls 34 defining the storage space 32. The plurality of walls 34 may include a front wall 36, a rear wall 38, opposing side walls 40, and a bottom wall 42. An adjustable divider wall 44 may be movably secured to the storage bin 30 within the storage space 32. The adjustable divider wall 44 may be operable to divide the storage space 32 into several storage spaces of varying sizes on opposing sides of the divider wall 44. The adjustable divider wall 44 may be configured to slide between the opposing side walls 40 to either increase or decrease the size of the several storage spaces that are defined on the opposing sides of the divider wall 44.

The storage bin 30 includes a protrusion 46 extending outward from an edge of a first of the plurality of walls 34. More specifically, the protrusion 46 may extend upward from an upper edge 48 of the front wall 36. The protrusion 46 also extends between opposing lateral ends of the first of the plurality of walls 34. More specifically, the protrusion 46 also extend between opposing lateral ends 50 of the front wall 36. The opposing lateral ends 50 of the front wall 36 are adjacent to, proximal to, or connected to the opposing side walls 40. Therefore, it may also be said that the protrusion 46 extends between the opposing side walls 40.

The protrusion 46 may be elongated in a direction extending between the opposing lateral ends of the first of the plurality of walls 34. More specifically, the protrusion 46 may be elongated, in a direction 52 extending between the opposing lateral ends 50 of the front wall 36. Therefore, the protrusion 46 may be referred to as the elongated protrusion. The protrusion may be elongated such that the protrusion 46 spans at least half of a distance 54 extending between the opposing lateral ends 50 of the front wall 36 or at least half of the distance between the opposing sides walls 40.

However, the protrusion 46 may be elongated such that that the protrusion 46 extends any distance that is at least half of the distance 54 extending between the opposing lateral ends 50 of the front wall 36 or at least half of the distance between the opposing sides walls 40. For example, the protrusion 46 may extend 50% or more of the distance between the opposing lateral ends 50 of the front wall 36 or the distance between the opposing sides walls 40, the protrusion 46 may extend 60% or more of the distance between the opposing lateral ends 50 of the front wall 36 or the distance between the opposing sides walls 40, 70% or more of the distance between the opposing lateral ends 50 of the front wall 36 or the distance between the opposing sides walls 40, 80% or more of the distance between the opposing lateral ends 50 of the front wall 36 or the distance between the opposing sides walls 40, 90% or more of the distance between the opposing lateral ends 50 of the front wall 36 or the distance between the opposing sides walls 40, 100% of the distance between the opposing lateral ends 50 of the front wall 36 or the distance between the opposing sides walls 40, etc.

The storage bin 30 may include an overhanging region 56 extending laterally outward from the storage bin 30 along the edge of the first of the plurality of walls 34 and along a first side of the storage bin 30. More specifically, the overhanging region 56 may extend laterally outward from the storage bin 30 along the upper edge 48 of the storage bin 30 and along the front wall 36. The overhanding region 56 may include the upper edge 48 of the storage bin 30. Therefore, the protrusion 46 may be said to extend upward from the overhanging region 56. The overhanging region 56 may form a handle for engaging the storage bin 30 such that a user may engage the overhanding region 56 to move or slide the storage bin 30 into and out of a corresponding compartment of the refrigerator (e.g., the fresh food compartment 12 or the freezer compartment 14).

The overhanging region 56 may also include a panel or wall 57 that extends downward from the upper edge 48 on an opposing side the upper edge 48 relative to the front wall 36 such that a space 59 is defined between front wall 36 and wall 57. A user may more specifically engage the wall 57 within the space 59 to move or slide the storage bin 30 into and out of a corresponding compartment of the refrigerator (e.g., the fresh food compartment 12 or the freezer compartment 14).

The protrusion 46 has at least one ramped surface 58 and tapers along the at least one ramped surface in a direction that extends away from the edge of the first of the plurality of walls 34. More specifically, the least one ramped surface 58 tapers along the at least one ramped surface in direction 60, which extends upward and away from the upper edge 48 of the front wall 36 or upward and away from the overhanging region 56. The at least one ramped surface 58 may include a first ramped surface 62 and a second ramped surface 64. The first ramped surface 62 and the second ramped surface 64 may taper toward each other in the direction that extends away from the edge of the first of the plurality of walls 34. More specifically, the first ramped surface 62 and the second ramped surface 64 may taper toward each other in the direction 60, which extends upward and away from the upper edge 48 of the front wall 36 or upward and away from the overhanging region 56.

The storage bin 30 includes a trim 66 having a base 68 and opposing snaps 70 extending downward from the base 68. The snaps 70 are operable for lateral displacement (e.g., displacement laterally outward along direction 72) upon engagement with the least one ramped surface 58 (e.g., the first ramped surface 62 and the second ramped surface 64). The snaps 70 are also operable to engage a lower region 74 of the protrusion 46 to secure the trim 66 to the protrusion 46. The base 68 may be referred to as an upper wall or top panel.

The snaps 70 may comprise opposing side panels or side walls 76 that extend downward from the base 68 (or upper wall) and barbs 78 that are disposed along opposing ends of the side walls 76 relative to the base 68 (or upper wall). Alternatively, the barbs 78 could be disposed along the side walls 76 between the opposing ends of the side walls 76 and the base 68. The barbs 78 and at least a portion of the side walls 76 adjacent to the barbs 78 are operable for lateral displacement (e.g., displacement laterally outward along direction 72) upon engagement between the barbs 78 with the least one ramped surface 58 (e.g., the first ramped surface 62 and the second ramped surface 64). The side walls 76 may be biasing elements that operate to bias the barbs 78 laterally inward (e.g., laterally inward along direction 72) and into engagement with the protrusion 46.

The trim 66 may be elongated in a direction extending between the opposing lateral ends of the first of the plurality of walls 34. More specifically, the trim 66 may be elongated, in a direction 52 extending between the opposing lateral ends 50 of the front wall 36. Therefore, the trim 66 may be referred to as the elongated trim. The trim may be elongated such that the trim 66 spans at least half of the distance 54 extending between the opposing lateral ends 50 of the front wall 36 or at least half of the distance between the opposing sides walls 40.

However, the trim 66 may be elongated such that that trim 66 extends any distance that is at least half of the distance 54 extending between the opposing lateral ends 50 of the front wall 36 or at least half of the distance between the opposing sides walls 40. For example, the trim 66 may extend 50% or more of the distance between the opposing lateral ends 50 of the front wall 36 or the distance between the opposing sides walls 40, 60% or more of the distance between the opposing lateral ends 50 of the front wall 36 or the distance between the opposing sides walls 40, 70% or more of the distance between the opposing lateral ends 50 of the front wall 36 or the distance between the opposing sides walls 40, 80% or more of the distance between the opposing lateral ends 50 of the front wall 36 or the distance between the opposing sides walls 40, 90% or more of the distance between the opposing lateral ends 50 of the front wall 36 or the distance between the opposing sides walls 40, 100% of the distance between the opposing lateral ends 50 of the front wall 36 or the distance between the opposing sides walls 40, etc.

The lower region 74 of the protrusion 46 defines at least one notch, slot, or groove 80 that extends laterally inward (e.g., laterally inward along direction 72). The snaps 70, or more specifically the barbs 78, are operable to engage the lower region 74 of the protrusion 46 within the at least one groove 80 to secure the trim 66 to the protrusion 46 and to restrict movement of the trim 66 (e.g., movement of the trim 66 in a direction away from the edge of the first of the plurality of walls 34 or movement of the trim 66 in direction 60, which extends upward and away from the upper edge 48 of the front wall 36).

The top panel, upper wall, or base 68 may be sloped. For example, the base 68 may extend along an angle that is greater than 0° and less than 90° relative to a direction that extends away from the edge of the first of the plurality of walls 34, relative to direction 60, which extends upward and away from the upper edge 48 of the front wall 36, relative to a vertical direction, or relative to a horizontal direction.

A first of the snaps 70 or a first of the opposing sides walls 76 of the snaps 70 may have a substantially flat or substantially planar external surface 82. A second of the snaps 70 or a second of the opposing sides walls 76 of the snaps 70 may have a concave external surface 84. As used herein, substantially flat or substantially planar refers to a flat surface that has no deviations from a perfectly flat plane or has deviations from the perfectly flat plane that are less than a tolerance of 3 millimeters (mm). For example, the first of the snaps 70 or the first of the opposing sides walls 76 may have an allowable tolerance of 3 mm or less, 2 mm or less, 1 mm or less, 0.5 mm or less, 0.25 mm or less, 0.1 mm or less, etc. from a corresponding perfectly flat plane.

Figure 6:
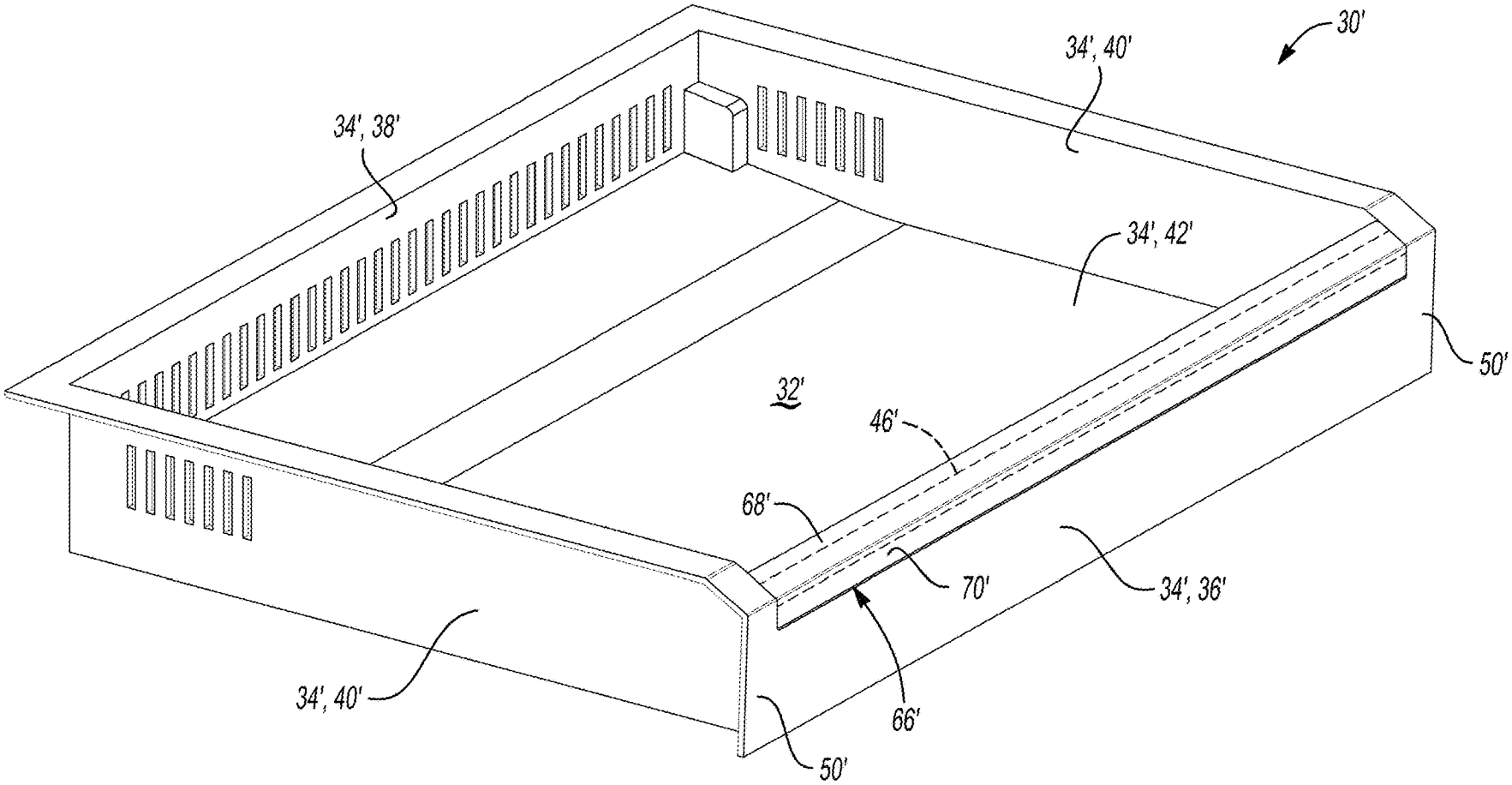
FIG. 6 is a perspective upper view of a second type of storage bin that is disposed within one of the compartments of the refrigerator.

Referring to FIG. 6, a second type of storage bin 30' that is disposed within one of the compartments of the refrigerator (e.g., the fresh food compartment 12 or the freezer compartment 14) is illustrated. The second type of storage bin 30' may correspond to one of the storage bins, storage baskets, storage receptacles, or drawers 17 depicted in FIG. 1 or to one of the storage bins, storage baskets, drawers, or storage receptacles 26 depicted in FIGS. 1 and 2.

It should be understood that storage bin 30' has all the same subcomponents and functionality as storage bin 30 unless otherwise stated or illustrated herein. Furthermore, it should be understood that any component having a callout number in FIG. 6 that includes a prime symbol (') should be construed as having the same structure, subcomponents, and functionality as a component illustrated in FIGS. 3-5 that includes the same callout number but without the prime symbol, unless otherwise stated or illustrated herein.

The storage bin 30' defines a storage space 32'. More specifically, the storage bin 30' includes a plurality of walls 34' defining the storage space 32'. The plurality of walls 34' may include a front wall 36', a rear wall 38', opposing side walls 40', and a bottom wall 42'.

The storage bin 30' includes a protrusion 46' extending outward from an edge of a first of the plurality of walls 34'. More specifically, the protrusion 46' may extend upward from an upper edge of the front wall 36'. The protrusion 46' also extends between opposing lateral ends of the first of the plurality of walls 34'. More specifically, the protrusion 46' also extend between opposing lateral ends 50' of the front wall 36'. The opposing lateral ends 50' of the front wall 36' are adjacent to, proximal to, or connected to the opposing side walls 40'. Therefore, it may also be said that the protrusion 46' extends between the opposing side walls 40'.

The protrusion 46' has at least one ramped surface and tapers along the at least one ramped surface in a direction that extends away from the edge of the first of the plurality of walls 34'. More specifically, the least one ramped surface tapers along the at least one ramped surface in direction, which extends upward and away from the upper edge of the front wall 36'. The at least one ramped surface may include a first ramped surface and a second ramped surface. The first ramped surface and the second ramped surface may taper toward each other in the direction that extends away from the edge of the first of the plurality of walls 34'. More specifically, the first ramped surface and the second ramped surface may taper toward each other in the direction which extends upward and away from the upper edge of the front wall 36'.

The storage bin 30' includes a trim 66' having a base 68' and opposing snaps 70' extending downward from the base. The snaps are operable for lateral displacement (e.g., displacement laterally outward along direction) upon engagement with the least one ramped surface (e.g., the first ramped surface and the second ramped surface of the protrusion 46'). The snaps are also operable to engage a lower region of the protrusion 46' to secure the trim 66' to the protrusion 46'.

The storage bin 30' may be different from the storage bin 30 in that the storage space 32' is shallower than the storage space 32, that the opposing side walls 40' have a much smaller ramped region along the front edges of the opposing side walls 40' relative a ramped region on opposing side walls 40, and that the storage bin 30 does not include a divider wall (e.g., adjustable divider wall 44).

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator appliance comprising:

a cabinet defining an internal refrigerated cavity; and a storage bin slidably secured to the cabinet within the internal cavity, the storage bin comprising, a plurality of walls defining a storage space, a protrusion extending upward from an upper edge of a front wall of the plurality of walls, wherein the protrusion has at least one ramped surface and tapers along the at least one ramped surface in a direction extending upward and away from the upper edge of the front wall, and a trim having a top panel and opposing snaps extending downward from the top panel, wherein (i) the snaps include barbs and side walls extending between the barbs and the top panel and (ii) the barbs are operable for lateral displacement upon engagement with the at least one ramped surface and engage a lower region of the protrusion to secure the trim to the protrusion, and wherein thicknesses of the side walls are greater along first regions that are adjacent to the barbs relative to second regions that are adjacent to the top panel to facilitate lateral displacement of the barbs.

2. The refrigerator appliance of claim 1, wherein the at least one ramped surface includes first and second ramped surfaces, and wherein the first and second ramped surfaces taper toward each other in the direction extending upward and away from the upper edge of the front wall.

3. The refrigerator appliance of claim 1, wherein the lower region of the protrusion defines at least one groove extending laterally inward, and wherein the snaps engage the lower region of the protrusion within the at least one groove to secure the trim to the protrusion and to restrict upward movement of the trim.

4. The refrigerator appliance of claim 1, wherein the trim is elongated in a direction extending between opposing lateral ends of the front wall such that the trim spans at least half of a distance extending between the opposing lateral ends of the front wall.

5. The refrigerator appliance of claim 4, wherein the protrusion is elongated in the direction extending between opposing lateral ends of the front wall such that the protrusion spans at least half of a distance extending between the opposing lateral ends of the front wall.

6. The refrigerator appliance of claim 1, wherein the top panel of the trim is sloped.

7. The refrigerator appliance of claim 1, wherein a first of the snaps has a substantially planar external surface.

8. The refrigerator appliance of claim 7, wherein a second of the snaps has a concave external surface.

9. The refrigerator appliance of claim 1, wherein the thicknesses of the side walls decrease gradually along tapers that are positioned between the first regions and second regions.

10. The refrigerator appliance of claim 9, wherein the thicknesses of the side walls are constant along the first regions and the second regions.

11. A storage bin for a refrigerator appliance comprising:

a basket defining a storage space;

an overhanging region extending laterally outward from the basket along an upper edge of the basket and along a first side of the basket, wherein the overhanging region forms a handle for engaging the basket;

a protrusion extending upward from the overhanging region, wherein the protrusion has at least one ramped surface and tapers along the at least one ramped surface in a direction extending upward and away from the overhanging region; and a trim having an upper wall, opposing side walls extending downward from the upper wall, and barbs disposed along opposed ends of the side walls relative to the upper wall, wherein the barbs (i) are operable for lateral displacement upon engagement with the at least one ramped surface and (ii) engage a lower region of the protrusion to secure the trim to the protrusion, and wherein thicknesses of the side walls are greater along first regions that are adjacent to the barbs relative to second regions that are adjacent to the upper wall to facilitate lateral displacement of the barbs.

12. The storage bin of claim 11, wherein a first of the opposing side walls of the trim has a concave external surface.

13. The storage bin of claim 11, wherein the thicknesses of the side walls decrease gradually along tapers that are positioned between the first regions and second regions.

14. The storage bin of claim 13, wherein the thicknesses of the side walls are constant along the first regions and the second regions.

15. A storage basket for a refrigerator appliance comprising:

a plurality of walls defining a storage space;

an elongated protrusion extending outward from an edge of a first wall of the plurality of walls and between opposing lateral ends of the first wall, wherein the elongated protrusion has ramped surfaces and tapers along the ramped surfaces in a direction extending away from the edge of the first wall; and an elongated trim having a base and opposing snaps extending downward from the base, wherein (i) the snaps include barbs and side walls extending between the barbs and the base and (ii) the barbs are operable for lateral displacement upon engagement with the ramped surfaces and engage a lower region of the protrusion to secure the trim to the protrusion, wherein the elongated trim extends between the opposing lateral ends of the first wall, and wherein thicknesses of the side walls are greater along first regions that are adjacent to the barbs relative to second regions that are adjacent to the base to facilitate lateral displacement of the barbs.

16. The storage basket of claim 15, wherein the ramped surfaces include first and second ramped surfaces, and wherein the first and second ramped surfaces taper toward each other in the direction extending away from the edge of the first wall.

17. The storage basket of claim 15, wherein the base of the trim is sloped.

18. The storage basket of claim 15, wherein a first of the snaps has a substantially planar external surface and a second of the snaps has a concave external surface.

19. The storage basket of claim 15, wherein the thicknesses of the side walls decrease gradually along tapers that are positioned between the first regions and second regions.

20. The storage basket of claim 19, wherein the thicknesses of the side walls are constant along the first regions and the second regions.

* * * * *